US006149030A

United States Patent [19]

Lemaire et al.

[11] Patent Number: 6,149,030

[45] **Date of Patent: *Nov. 21, 2000**

[54] CHILD RESISTANT SPOUT

[75] Inventors: Liesbeth Johanna Carolina Lemaire, Roosdaal; Carol Smith, Brussels, both of Belgium

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/036,439

[22] Filed: Mar. 9, 1998

[51] Int. Cl.[7] ..... B65G 59/00

[52] U.S. Cl. ..... 221/92; 215/245

[58] Field of Search ..... 221/92, 45, 282; 215/244, 245, 237, 216; 220/315, 810

[56] References Cited

U.S. PATENT DOCUMENTS

| | | | |
|---|---|---|---|
| 1,333,479 | 3/1920 | Farmer . | |
| 2,711,241 | 6/1955 | Abrahamsen | 193/38 |
| 3,289,885 | 12/1966 | Villaveces | 221/288 |
| 4,099,650 | 7/1978 | Immordino | 221/266 |
| 4,712,712 | 12/1987 | Garden | 221/68 |
| 5,377,866 | 1/1995 | Watters, II | 221/194 |

FOREIGN PATENT DOCUMENTS

| | | | |
|---|---|---|---|
| 0084617 | 8/1983 | European Pat. Off. . | |
| 0573859A2 | 12/1993 | European Pat. Off. . | |
| 941300 | 1/1949 | France . | |
| 94105197U1 | 9/1994 | Germany . | |
| 2035274 | 6/1980 | United Kingdom | 215/245 |

*Primary Examiner*—Kenneth W. Noland
*Attorney, Agent, or Firm*—James C. Vago

[57] ABSTRACT

The present invention provides a package for dispensing tablets. The package comprises a dispensing opening. The dispensing opening comprises a hinged spout. The hinged spout enables the dispensing of the tablets from within the package in its open position. The hinged spout engages with the rest of the package in its closed position. The engagement between the hinged spout and the package comprises a hook and holder whereby the hook is flexibly and resiliently deflected from its rest position to engage with and to disengage from the holder. The hook is provided with reinforcing means located adjacent the hook so that the resiliency of the hook is enhanced by the reinforcing means for the engagement with and the disengagement from the holder.

19 Claims, 6 Drawing Sheets

CHILD RESISTANT SPOUT

FIELD OF THE INVENTION

The present invention relates to a reinforced child resistant spout of a package.

BACKGROUND OF THE INVENTION

Child resistant packaging is understood to be an important concept for preventing inadvertent access by children, for example, to potentially dangerous liquid or dry products. The packaging industry is in need of preventing children the access to detergent tablets which may be ingested by children. This means especially the apertures to the interior of the packages have to be protected from opening by children. Detergent compositions formed in non particulate solids such as bars or tablets briquettes are known in the art. In the following, the term "tablets" will refer to any form of non particulate solids. The detergent tablets available on the market are generally sold packed in containers in a loose way or individually wrapped in bags.

Due to the difficulty in opening child resistant packages, many persons, especially elderly adults who may also have impaired strength and dexterity, tend to prefer a non-child resistant package. Alternatively, when dangerous products are purchased in child resistant packages by adults, the child resistant package is often left unclosed in order to defeat the child resistant feature. As a result, the danger of child poisonings may increase in the home.

The aforementioned problems are generally recognized in the packaging industry. The dispensing of the tablets is foreseen through a dispensing opening comprising a hinged spout. Child resistant features on the hinged spout are also foreseen to prevent the opening of the hinged spout by children. Such child resistant spouts are obtained by a double or coordinated action on the spout to open the spout itself. In particular, a hook interacting with a slot is de scribed in FIGS. 8*a* to 8*d*. The opening of the spout is achieved by disengaging the hook from the slot and pulling the spout open. This child resistant spout is simple to use for adults and a good deterrent to opening for children.

Nevertheless, it has been found that this hook/slot engagement may become weaker with use. This means that it may become easier to disengage the hook from the slot. Consequently, the resistance to opening this spout by children is diminished with frequent opening of the spout.

It is therefore an object of the present invention to maintain an effective engagement between the hook and the slot of the hinged spout avoiding substantial weakening of the engagement.

SUMMARY OF THE INVENTION

The present invention provides a package for dispensing tablets which has a dispensing opening and a hinged spout. The hinged spout enables the dispensing of the tablets from within the package in its open position. The hinged spout engages with the rest of the package in its closed position. The engagement between the hinged spout and the package comprises a hook and holder whereby the hook is flexibly and resiliently deflected from its rest position to engage with and to disengage from the holder. The hook is provided with reinforcing means located adjacent the hook so that the resiliency of the hook is enhanced by the reinforcing means after deflecting the hook for engagement with and disengagement from the holder.

DETAILED DESCRIPTION OF THE INVENTION

Figure 1:
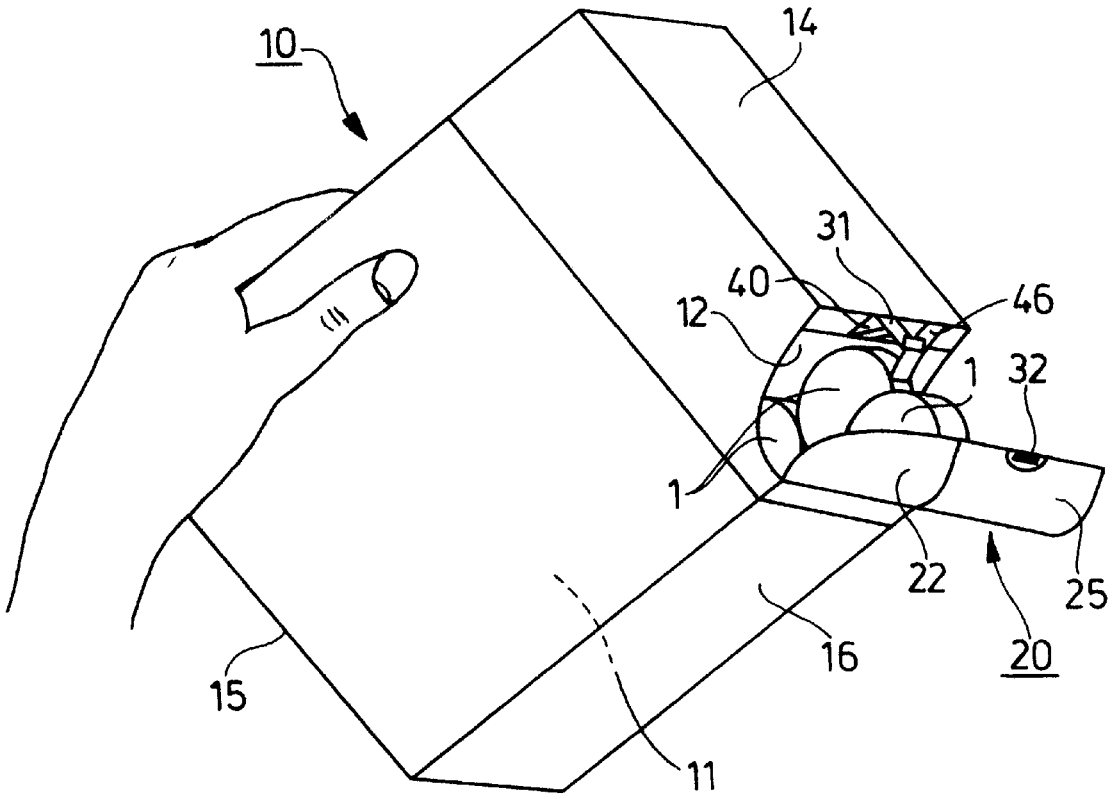
FIG. 1 is a perspective front view of the preferred embodiment of the package according to the present invention.

FIG. 1 shows a package 10 according to the present invention. The package 10 comprises a hollow body 11 and a dispensing opening 12. The hollow body 11 preferably comprises a top wall 14, a bottom wall 15 opposed to the top wall 14 and a surrounding wall 16 surrounding the hollow body 11 and connected to the top wall 14 and the bottom wall 15. The bottom wall 15 is part of the package 10 upon which the package 10 stands in an upright position. Preferably, external shape of the hollow body 11 may be substantially rectangular. Preferably, when the package 10 stands in an upright position, the dispensing opening 12 is located on upper portion of the surrounding wall 16, as shown in FIG. 1, or on the top wall 14.

Preferably, the inside of the hollow body 11 is filled with tablets. In the following any form of non particulate solids such as bars or tablets or briquettes will be encompassed by the term "tablet" 1. Pharmaceuticals in tablet form are, for example, tablets according to the present invention. Preferably, the tablet is made of a detergent composition, specifically a detergent composition for washing of laundry or dishes. The tablet may have any shape or dimension. Preferably, the solid, non particulate tablet is symmetrical to ensure the uniform dissolution of the tablet in the wash liquor or in other specific environments.

According to the present invention a detergent tablet 1 may comprise any ingredients known in the art. Such ingredients may include surfactants, suds suppressers, bleaches, chelants, builders, enzymes, fillers and perfumes.

Preferably, the detergent composition of the tablet 1 is prepared in its granular or particulate form and then formed into tablets of the desired shape and size by any one of the methods known in the art. Suitable methods include compression, extrusion and casting. The detergent composition may be homogeneously distributed throughout the tablet 1 or may comprise distinct layers of certain detergent ingredients. Preferably, the shape of the detergent tablet 1 is cylindrical, as shown, for example, in FIG. 7*a*. In this case the dimensions of detergent tablet 1 are defined by the diameter (d) and by the height (h). Usually, detergent tablets have a cylindrical shape with the diameter being greater than the height of the tablet. Another possible shape of the tablet 1 is rectangular, as shown, for example in FIG. 7*b*. In this case the dimensions of this detergent tablet 1 are defined by the length (L), by the width (w) and by the height (h). Usually, in a rectangular tablet the length is the greatest dimension and the width is equal to the height.

As a preferred option, the top wall 14 of the hollow body 11 comprises a refilling opening. The refilling opening allows to refill the hollow body 11 with new detergent tablets 1 once the package 10 is emptied. Therefore, the dimension of the refilling opening corresponds at least to the dimension of a tablet. As a preferred option, the refilling opening is closed by a closure, more preferably by a child resistant closure. The child resistant closure is adapted to prevent the removal of the tablet 1 through the refilling opening by infants and children. In particular, as used herein, the wording "child resistant closure" refers to any mechanism whereby access to the tablet 1 is reduced so that the tablet 1 cannot be readily removed, especially by infants and children. An example of a child resistant closure is a closure on which the user has to apply a double or coordinated action on the closure to open the closure. For example, such child resistant closures are press-and-turn or press-and-pull closures known by the person skilled in the art.

The dispensing opening 12 is dimensioned in such a manner to enable the passage of at least one tablet 1. Preferably, the dispensing opening 12 is made of a rectangular cut through the thickness of the surrounding wall 16 and/or the top wall 14. For a cylindrical tablet as described above, the dispensing opening 12 is made preferably of a cut having the length equal or greater than the diameter (d) and the width equal or greater than the height (h) of a cylindrical tablet. For a rectangular tablet as described above, the dispensing opening 12 is made preferably of a cut. This cut has the length equal or greater than the length (L) of a rectangular tablet, whereby the width of this cut is equal or greater than the width (w) or height (h) of a rectangular tablet. Most preferably, the dispensing opening 12 is located on that part of the surrounding wall 16 having the smallest dimension, as shown in FIG. 1.

As a preferred option, the hollow body 11 of the package 10 comprises a funnel (not shown) around the dispensing opening 12 to convey the tablets 1 from the interior of the hollow body 11 towards the dispensing opening 12. This funnel should be made in such a manner that the tablets 1 are prevented to jam in the interior of the hollow body 11 and in front of the dispensing opening 12 blocking the exit through the dispensing opening 12 for other tablets 1. This funnel may be, for example, conically shaped located in the interior of the hollow body 11 having the smallest dimension in front of the dispensing opening 12. This funnel directs the tablets 1 towards the dispensing opening 12 in such a manner that the tablets 1 pass through the dispensing opening 12 without blocking each other.

Figure 3A:
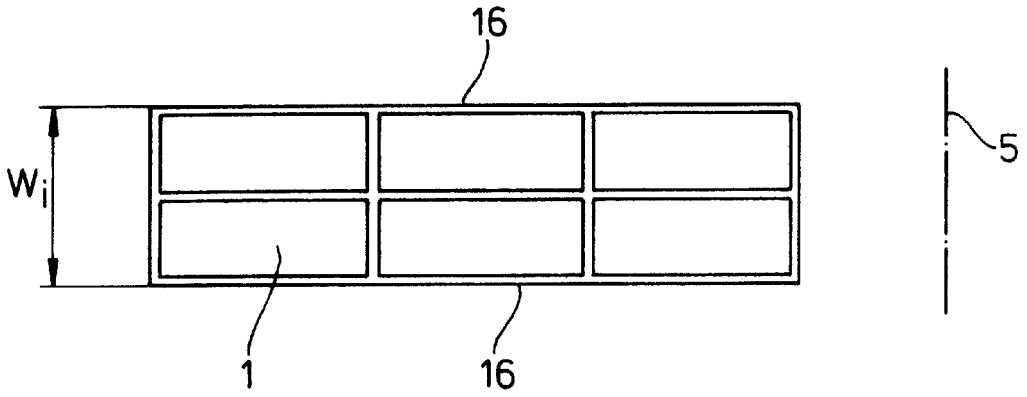
FIGS. 3*a* and 3*b* are cross sectional top views of an embodiment of the package according to the present invention.

As another preferred option, the internal dimension of the hollow body 11 is such that the tablets 1 are orderly spaced one to each other. This also prevents that the tablets 1 jam in the interior of the hollow body 11 and in front of the dispensing opening 12 blocking the exit through the dispensing opening 12 for other tablets 1. This is achieved by limiting the internal width (FIG. 3*a*, Wi) of hollow body 11 to a width which is smaller than the largest dimension of the tablets 1. The "internal width" is hereinafter defined to be shortest distance between adjacent walls in a direction along the drawn line 5 in FIG. 3*a*. FIG. 3*a* is a cross sectional cut of the package 10 according to the present invention on a plane parallel to the bottom wall 15 of the package 10.

Figure 7A:
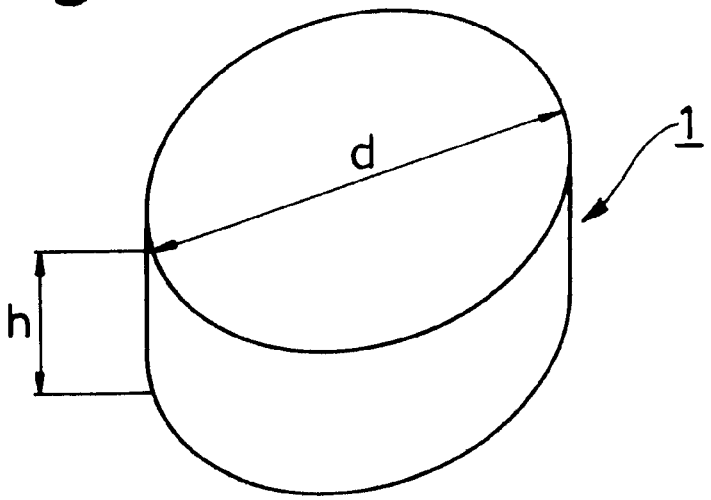
FIGS. 7*a* and 7*b* are perspective front views of a detergent tablet which ay be used in any of the embodiments of packages according to the present invention.
Figure 7B:
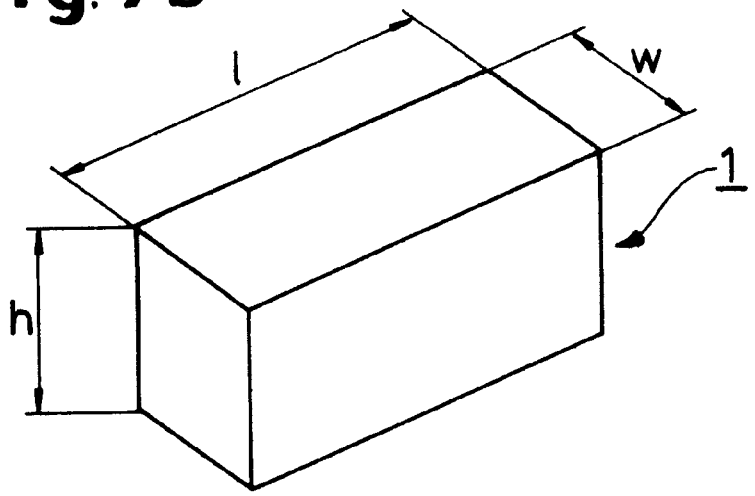

For example, when the tablet 1 has a cylindrical-type of shape as described above, such detergent tablet 1 may only enter into the hollow body 11, if the tablet 1 is placed onto the bottom wall 15 standing on the surface having the smallest dimension, i.e. its height (h) (FIG. 7*a*). This means that the tablet 1 can never lay on the surface defining the diameter (d) of the tablet 1. Consequently, the tablets 1 are ordered in a row, as shown, for example, in FIG. 3*a*. As hereinafter referred to, a "row of tablets" is meant to be a row of tablets standing upon the bottom wall 15 or upon another row of the tablets 1 whereby each tablet 1 stands on the part of the tablet 1 having the smallest dimension, i.e. on the height (h) for the tablets 1 defined before. Therefore, the internal width is a distance perpendicular to the row.

It has been found that this way of positioning the tablets 1 reduces the friction forces acting onto the tablets 1. Reducing the friction forces permits an easy dispensing of the tablets 1 from the package 10 avoiding the tablets 1 block each other from exiting the package 10. This is particularly important when the tablets 1 are big and/or heavy where the friction forces between the tablets 1 are substantially high. For example, friction forces between tablets may influence the dispensing of the tablets 1 from the package 10 when the largest dimension of the tablet is greater than 1 cm and/or the weight of the tablet 1 is greater than 10 g. The roughness of the external surfaces of the tablets 1 also contributes to increase the friction forces between the tablets 1.

The friction forces between the tablets 1 are reduced in the package 10 according to this embodiment of the present invention. Indeed, only the smallest surface of a tablet interacts with other tablets 1 and/or with the end wall 25. Furtherrnore, when the tablet 1 is cylindrically shaped as described before, the tablet 1 is able to roll towards the dispensing opening 12 which further reduces the friction. Therefore, the tablet 1 in the hollow body 11 cannot block other tablets 1 contained in the hollow body 11 from exiting through the dispensing opening 12.

In a preferred embodiment of the present invention the tablets 1 are orderly held in the hollow body 11 in one row within its internal width (Wi). Other single rows may be placed on top of the lowest row starting from the row standing on the bottom wall 15 until the hollow body 11 is filled up to the top wall 14. As another possibility, the hollow body 11 may be such to contain more than one row of tablets parallel to each other within the internal width (Wi), when the diameter (d) or the length of the tablet is greater than twice the height of the tablet. Indeed, the hollow body 11 may contain, for example, two parallel rows of tablets within the internal width (Wi), as shown in FIG. 3*a*. Also in this case, the diameter (d) or the length of a tablet is greater than the width (Wi) of the hollow body 11, the width (Wi) being now equal or slightly greater than twice the height of a tablet. Again, these double rows of tablets are placed each over another filling up the hollow body 11 to the top wall 14 starting from the bottom wall 15. It has been found that when the tablets are placed inside the hollow body 11, the tablets automatically get ordered in these single or double rows. Indeed, the tablets are forced into one of the rows by the weight of the tablets of the above rows. The same applies for more than two parallel rows of tablets when the diameter of the tablet (d) is greater than n-times the height (h) of the tablet, n being greater or equal to 2.

Figure 3B:
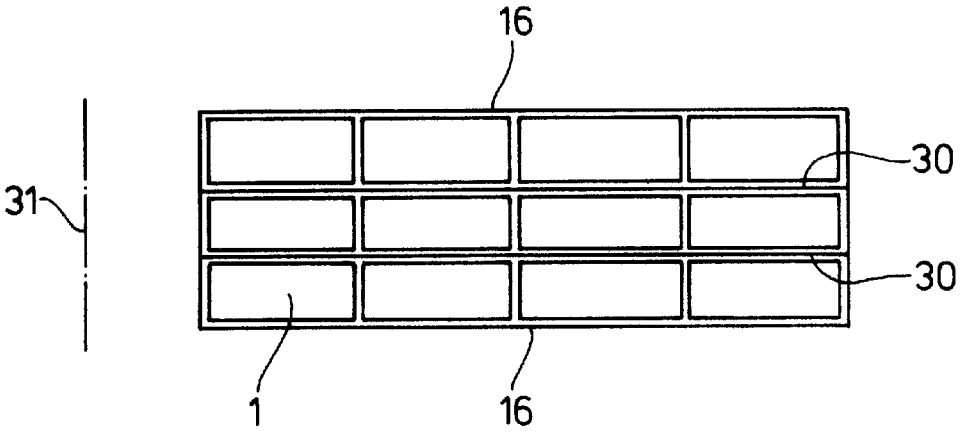

As a further preferred option, when two or more rows of the tablets 1 are to be placed inside the hollow body 11, the hollow body 11 comprises preferably at least one divider 30, as shown in FIG. 3*b*. FIG. 3*b* is again a cross sectional cut along a plane parallel to the bottom wall 15. The divider 30 is perpendicular to the direction drawn by line 31 in FIG. 3*b*. The divider 30 starts from the bottom wall 15 up to the top wall 14. The hollow body 11 may comprise more than one divider 30 to contain several rows of the tablets 1. The width (w) between the surrounding wall 16 and the divider 30 or between each divider 30 is smaller than the largest dimension, i.e. the diameter or the length, of the tablet 1.

Consequently, the dividers 30 divide the parallel rows of the tablets 1 from each other. In this manner, the friction between parallel rows is reduced to achieve an easy and readily dispensing of the tablets 1. When the hollow body 11 comprises the dividers 30, the package 10 may preferably comprise one dispensing opening 12 enabling the tablets 1 of each divided row to exit the package 10.

Figure 4A:
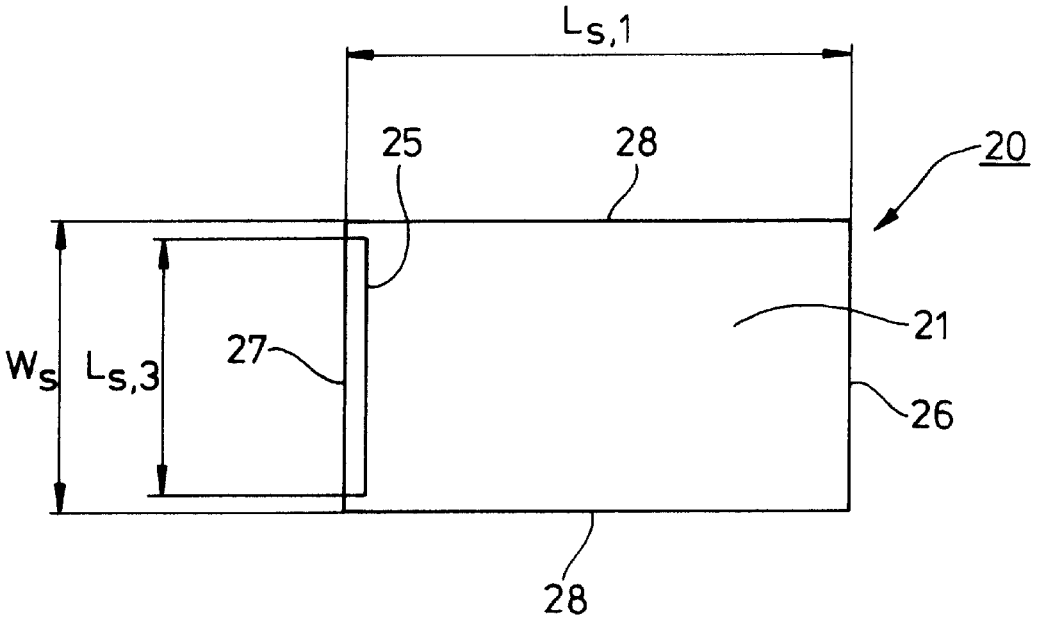
FIG. 4*a* is a top view and FIG. 4*b* is a side view of a hinged spout for the package according to the present invention.
Figure 4B:
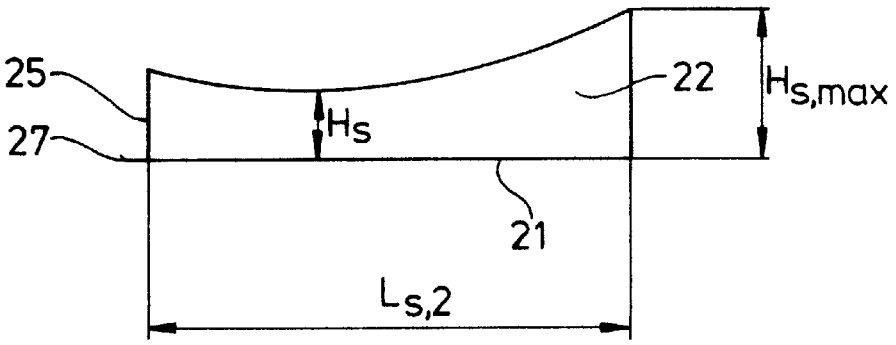

The dispensing opening 12 further comprises a hinged spout 20. In a preferred embodiment, as shown in FIGS. 4*a* and 4*b*, the hinged spout 20 comprises a supporting wall 21. One end edge 26 of the supporting wall 21 is connected to the package 10, specifically at the dispensing opening 12. The connection between the end edge 26 of the hinged spout 20 and the dispensing opening 12 is a hinge. The other edges of the supporting wall 21, i.e. the side edges 28 and end edge 27, are free from any attachments to the package 10. The hinged spout 20 is attached to the dispensing opening 12 in such a manner that a tablet 1 exiting the dispensing opening 12 is received by the hinged spout 20 when the hinged spout 20 is in its open position. For example, when the dispensing opening 12 is located on the surrounding wall 16, the supporting wall 21 is located under the dispensing opening 12 when the package 10 stands in its upright position and the hinged spout 20 is in its open position, as shown in (FIG. 1).

Preferably, the hinged spout 20 further comprises two side walls 22, more preferably two side walls 22 and an end wall 25. The side walls 22 and the end wall 25, if present, are all located on one side of the supporting wall 21. The two side walls 22 are preferably located along the side edges 28 (FIG. 4*a*) of the supporting wall 21. The side walls 22 are opposed to each other along the side edges 28 and 29. The side walls 22 may remain at the same distance from each other or the distance between the side walls 22 may become narrower or broader towards the end wall 25.

The end wall 25, if present, is located opposed to the dispensing opening 12 and is disposed parallel to the end edge 27 or the width (Ws) of the supporting wall 21, i.e. the end wall 25 is located at least partially along the width (Ws) of the supporting wall 21. For example, the end wall 25 may be a bar, whereby each end of the bar is connected to a side wall 22. Preferably, the end wall 25 is connected to the supporting wall 21 and located along the end edge 27. The end wall 25 and the side walls 22 are inclined walls with respect to the supporting wall 21, and the end wall 25 may also be inclined to the side walls. In a preferred embodiment of the hinged spout 20, the end wall 25 and the side walls 22 are connected to each other, therefore leaving no spaces between the end wall 25 and the adjacent side walls 22.

The shape and the dimensions of the hinged spout 20 are such to enable the receiving of a tablet 1 contained in the package 10. For example, when the package 10 contains cylindrical tablets, as described above, and the dispensing opening 12 has a rectangular shape the hinged spout 20 has preferably the following dimensions shown in FIGS. 4*a* and 4*b*. The width (Ws) of the supporting wall 21 is preferably slightly greater than the height (h) of the tablet 1. This allows the tablet 1 to stand on the surface of the tablet 1 having the smallest dimension, i.e. its height (h) (FIG. 7*a*). Consequently, the tablet 1 is facilitated to exit the dispensing opening 12 by rolling onto the supporting wall 21. Preferably, the width (Ws) of the supporting wall 21 is between about 1 times the height (h) of the tablet 1 and 1.5 times the height (h) of the tablet 1, more preferably about 1.2 times the height (h) of the tablet 1.

The dimensions of the preferred embodiment of the hinged spout 20 further comprising the end wall 25 and the side walls 22 are such that a tablet is retained on the hinged spout 20. The end 25 and the side walls 22 of the hinged spout 20 prevents the tablet 1 that exits from the dispensing opening 12 from falling from the hinged spout 20. Furthermore, while the tablet 1 remains on the hinged spout 20, the exit of other tablets through the dispensing opening 12 may be prevented. Indeed, the dimensions of the hinged spout 20 may allow only one tablet 1 to stay on the hinged spout 20. Consequently, other tablets 1 are prevented from leaving the dispensing opening 12 by the tablet 1 already retained on the hinged spout 20. Therefore, the hinged spout 20 enables a one-by-one dispensing of the tablets 1 through the dispensing opening 12. Furthermore, the additional end wall 25 prevents tablets 1 from falling in an uncontrolled manner from the dispensing opening 12. The user has only to grasp the tablet 1 which is held on the hinged spout 20. This avoids messiness in the dispensing of tablets 1.

The height (Hs) and lengths (Ls,2) and (Ls,3) of the side walls 22 and the end wall 25 respectively, if present, should provide a sufficient barrier which impedes the falling of the tablet 1 from the supporting wall 21 of the hinged spout 20. Consequently, the tablet 1 is held onto the hinged spout 20 with the help of the end and side walls & 22. By contrast, the height (Hs) of the end and side walls should not impede an easy grasping of the tablet by a user. The height is the minimum distance between the supporting wall and the upper edge of the end wall 25 or side walls. For, example, when the end wall 25 is a bar as described above, the height is the distance between the supporting wall and the upper edge of the bar. The length, however, is measured parallel to the end edge 27 or side edges 28 and 29, i.e. perpendicular to the height.

Preferably, the height (Hs) (FIG. 4*b*) of the side walls and the end wall 25 is between about 0.2 times the diameter (d) of the tablet and about 1 times the diameter (d) of the tablet. Most preferably, the height (Hs) of the side walls and the end wall 25 is about 0.5 times the diameter (d) of the tablet. As a preferred option, the height (Hs) of the end wall 25 is equal to the height of the side walls. As another preferred option, the height (Hs) of the side walls is not constant. For example, the height (Hs) of the side walls is curved increasing the height (Hs), as shown for example in FIG. 4*b*. In this case, the maximum height (Hs, max) is still within the range described before. The side walls may curve only at one end or at both ends of the side walls. The curvature may also be such to decrease the height (Hs) of the side walls, but still within the range of the height (Hs) as described before. The length (Ls,2) of the side walls is preferably between about 0.5 times to 1 times the length (Ls,1) of the supporting wall 21. The length (Ls,3) of the end wall 25 is preferably between 0.5 times to 1 times the width (Ws) of the supporting wall 21.

The distance between the end edge 26 and the end wall 25, if present, is preferably such that substantially a complete tablet has a sufficient space on the hinged spout 20. In this arrangement the tablet can easily exit from the dispensing opening 12 and can be easily grasped by the user. Preferably, the distance between the end edge 26 and the end wall 25 is between about 0.8 times the diameter (d) of the tablet and about 2 times the diameter (d) of the tablet, more preferably between about 1 times the diameter (d) of the tablet and about 1.6 times the diameter (d) of the tablet.

The hinged spout 20 according to the present invention enables the dispensing of the tablets from within the package 10 in its open position as described before. The hinged spout 20 engages with the rest of the package 10 in its closed position. This is achieved when the hinged spout 20 pivots around the end edge 26 hingedly connected to the package 10. The hinged spout 20 is therefore closed by pushing the hinged spout 20 into the dispensing opening 12, the hingedly connected end edge 26 acting as a hinge. The hinged spout 20 is blocked in the dispensing opening through an engagement between the hinged spout 20 and the rest of the package 10. The main engagement between the hinged spout 20 and the package 10 according to the present invention comprises a hook 31 and holder 32. The hook 31 engages with the corresponding holder 32 to provide a holding means.

The hook 31 and holder 32 engagement may provide a child resistant closing of the dispensing opening 12. The child resistant closing of the hinged spout 20 may prevent the removal of the tablet 1 through the dispensing opening by infants and children. In particular, as used herein, the wording "child resistant" refers to a mechanism whereby access to the tablet is reduced so that the tablet cannot be readily removed, especially by infants and children. Another example of a engagement between the hinged spout 20 and the rest of the package 10 which can be combined with the hook 31 and holder 32 engagement is a snapping engagement between the hinged spout 20 and the lip of the dispensing opening 12.

Figure 2A:
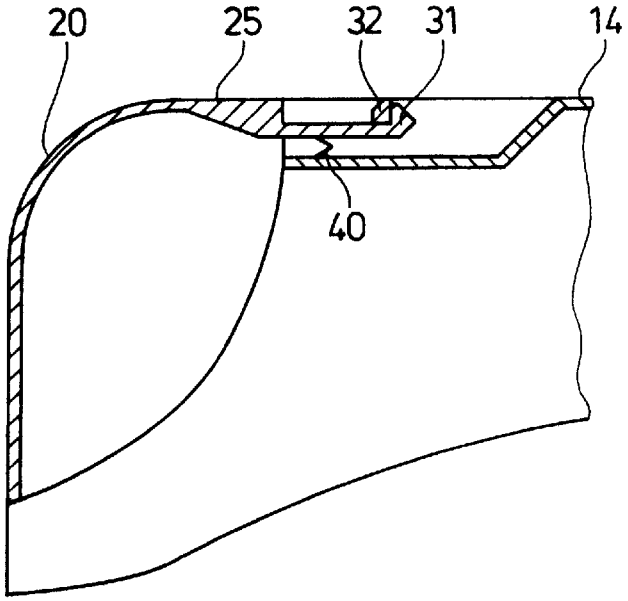
FIGS. 2*a* and 2*b* are cross sectional side views of further embodiments of the child resistant means according to the present invention.
Figure 2B:
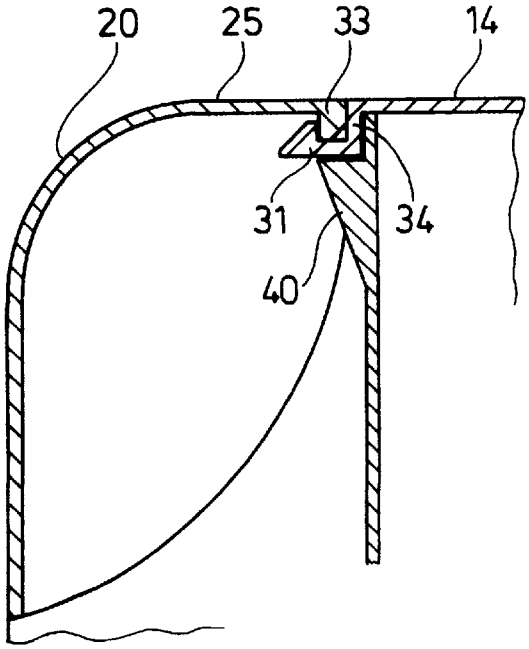

The hook 31 and holder 32 engagement according to the present invention is shown in FIGS. 1, 2*a* and 2*b*. The holder 32 engages with the hook 31 in such a manner that the hook 31 is retained by the holder 32 until the hook 31 is disengaged or unhooked from the holder 32. The hook 31 is flexibly and resiliently deflected from its rest position to engage with or disengage from the holder 32. The holder 32, located on the end wall 25 of the hinged spout 20, comprises a slot into which the hook 31, located on the top wall 14, at least partially snaps. The location of the hook 31 and the holder 32 may also be reversed to each other, as shown in FIG. 2*a*, i.e. the hook 31 may be located on the end wall 25 and the holder 32 on the top wall 14. To disengage the hook 31 from the slot, the hook 31 is pressed until the hook 31 exits from the slot.

The holder 32 may alternatively comprise a counter-hook 33, as shown in FIG. 2*b*. The hook 31 and counter-hook 33 are located in opposition to each other, whereby the hook 31 or counter-hook 33 may be located on the end wall 25 or the top wall 14. Preferably, the hook 31 or the counter-hook 33 may bent in such a manner that it conform to the rest of the outermost surface of the end wall 25 or the top wall 14, as shown in FIG. 2*b*. Indeed, the hook 33 of FIG. 2*b* located on the top wall 14 comprises a bent wall 34 uniting the hook 31 to the outermost surface of the top wall 14. By pressing on the top wall 14, the hook 31 can be disengaged from the counter-hook 33.

The hinged spout 20 may further comprises an additional child resistant means located between the side walls 22 of the hinged spout 20 and the surrounding wall 16 of the package 10. Consequently, to completely open the hinged spout 20, a further action has to be exerted onto the hinged spout 20. Such additional child resistant means, suitable for the package 10 according to the present invention, such as where the spout has to be first pressed on the side wall of the spout and then pulled. These additional child resistant means can be combined with the hook 31 and holder 32 engagement.

Preferably, the hook 31 is further provided with reinforcing means 40. The reinforcing means 40 is located adjacent the hook 31 so that the resiliency of the hook 31 is enhanced by the reinforcing means 40 for the engagement with and the disengagement from the holder 32. In this manner the engagement between the hook 31 and the holder 32 is reinforced. It has been found that the reinforcing means 40 ensures that an effective engagement, and also a child resistant engagement, between the hook 31 and the holder 32 is maintained even after repetitive opening and closing of the hinged spout 20. Without the reinforcing means 40 it has been observed that the engagement between the hook 31 and the holder 32 may become weaker with use and that it may be then easier for children to open the spout. The reinforcing means 40 according to the present invention is located with respect to the hook 31 such to counteract the disengagement direction of the hook 31 from the holder 32. For example, the reinforcing means 40 of FIGS. 1, 2*a* and 2*b* is located below the hook 31 when the package 10 is in its upright position.

The reinforcing means 40 may be rigid to reinforce the hook 31. This rigid reinforcing means 40 ensures that the hook 31 becomes less weakened in use. For example, a rigid reinforcing means 40 is a wall, as shown in FIGS. 1 and 2*b*. Alternatively, the reinforcing means 40 may be flexible and resilient. In this manner, the force needed to disengage or unhook the hook 31 from the holder 32 is not substantially increased. Nevertheless, the resilient reinforcing means 40 helps in pushing back the hook 31 in its original position with less tendency to weakening. For example, a flexible and resilient reinforcing means 40 may be a spring, whereby one end of the spring is connected to the hook 31 and the other end of the spring is connected to a wall of the package 10 as shown in FIG. 2*a*. Preferably, the reinforcing means 40 is part of a wall of the package 10 which is the most adjacent to the hook 31. Such a suitable wall of the package 10 may be the funnel around the dispensing opening as described above or a divider 30.

As a preferred option, the hinged spout 20 further comprises a stopping notch. The stopping notch stops the opening of the hinged spout 20 to a partial opening position of the hinged spout 20. Several stopping notches could be used, each of the stopping notches determining a different partial opening position of the hinged spout 20. Preferably, in a first opening position only one tablet is able to exit onto the hinged spout 20. This means that specifically this stopping notch ensures that tablets are dispensed one by one from the container. This is due to the inclination of the supporting wall 21 with respect to the full opening of the hinged spout 20. Indeed, the higher inclination limits the available space for the tablets. It has been found that the one by one dispensing of tablets can be made independent, with the help of the stopping notch, from the length of the supporting wall 21 of the hinged spout 20. Indeed, it has been found that the length of the supporting wall 21 may be greater than 1 time the diameter (d) of the tablet, and still only one tablet is able to exit on the hinged spout 20 when the stopping notch stops the opening of the hinged spout 20 to a partial opening position. When the hinged spout 20 is further opened passing over the stopping notch, the hinged spout 20 may be stopped by another stopping notch or, finally, the hinged spout 20 is completely opened.

The stopping notch may be located in any place of the hinged spout 20 such that the hinged spout 20 interacts with the opening 12 and stops the opening of the hinged spout 20 to a partial opening position. Preferably, the stopping notch is positioned on the outermost surface of at least one of the side wall 22 of the hinged spout 20. Specifically, the stopping notch is an extension protruding away from the outermost surface of at least one side wall. As a preferred option, both side walls 22 may comprise each a stopping notch. As another preferred option, several stopping notches may be provided on each of the side walls. The position of the stopping notch may also be such that the stopping notch interacts with the upper or lower portion of the opening when the package 10 stands in its upright position.

When the package 10 comprises divided rows of tablets, as described before with or without the dividers 30, the package 10 may preferably comprise a hinged spout 20 for each divided row of tablets. More preferably, the hinged spouts 20s are attached to the neighboring hinged spout 20 corresponding to another row of tablets forming a single hinged spout 20 capable of dispensing a multiple of tablets at the same time, as shown in FIG. 1. As an option, the opening comprises a retaining barrier 46, as shown in FIG. 1. As described before, the stopping notch on the hinged spout 20 stops the hinged spout 20 to a partial opening position. The partial opening position of the hinged spout 20 allows only one tablet at a time to exit onto the hinged spout 20 from one row. At the same time, the retaining barrier 46 on the opening prevents another tablet of another row from exiting onto the hinged spout 20. The retaining barrier may, for example, be a flap extending from the top edge of the opening 12 downwards, as shown in FIG. 1. Consequently, the tablets of only one row are allowed to exit onto the hinged spout 20.

Figure 5A:
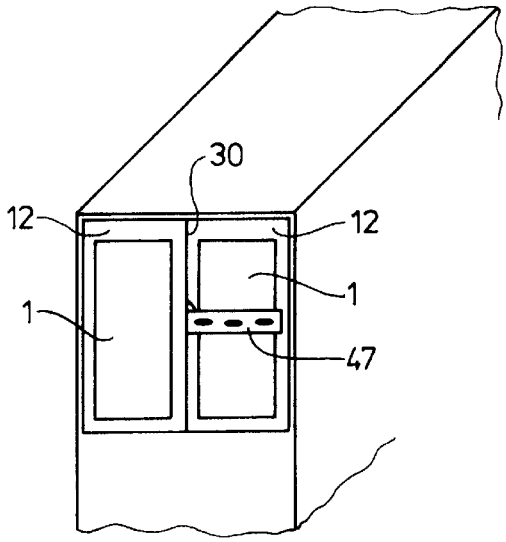
FIGS. 5*a*, 5*b*, 6*a* and 6*b* are front views of an embodiment of the package according to the present invention without the hinged spout.
Figure 5B:
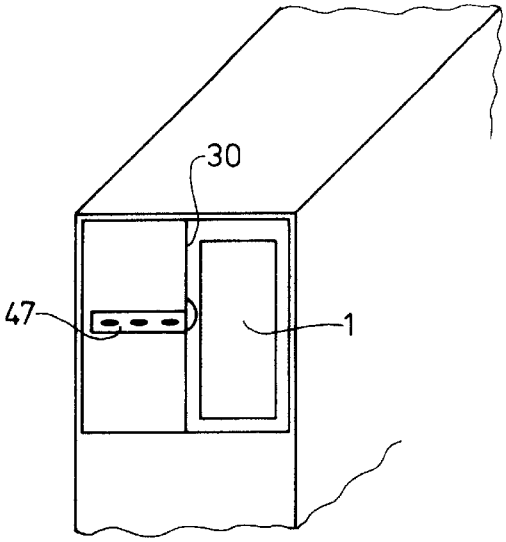
Figure 6A:
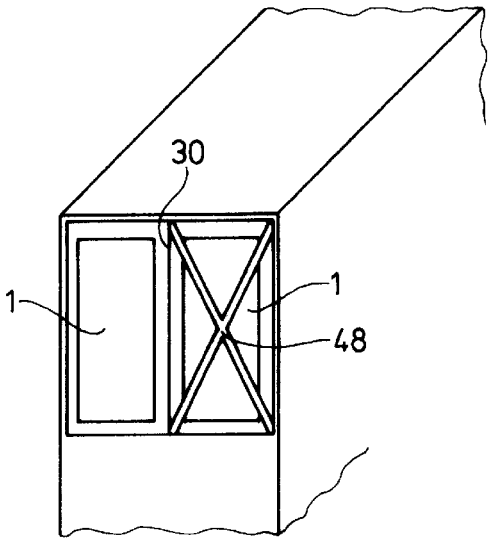
Figure 6B:
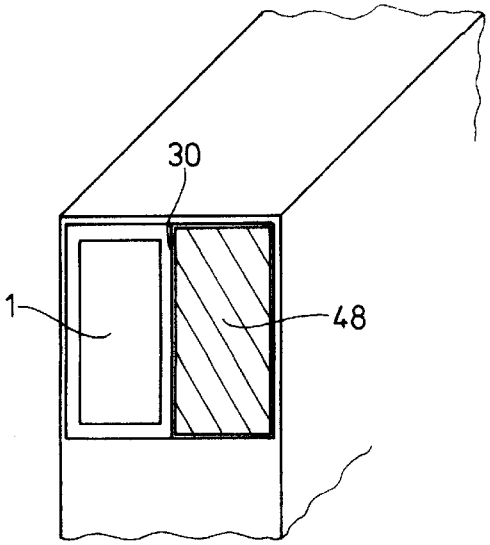

When the tablets of one row are finished, the hinged spout 20 may be opened further until the hinged spout 20 is again stopped by another stopping notch or the hinged spout 20 is completely opened. In one of these opening positions, the hinged spout 20 is sufficiently opened that the tablets of the other row are able to pass under the retaining barrier 46. The retaining barrier may also be a flap 47 hinged on a divider 30 in the opening region, as shown in FIGS. 5*a* and 5*b*. The hinged flap 47 extending into the opening of the tablets of a row prevents the exit of these tablets (FIG. 5*a*). Once one row is emptied, the hinged flap 47 is turned to the empty row, as illustrated in FIG. 5*b* enabling the tablets of the other row to exit on the hinged spout 20. Another possibility is a removable cover 48 which can be applied in the opening region of one row of tablets, as shown in FIGS. 6*a* and 6*b*. The removable cover may be anything which impedes the exit of tablets through the opening. For example, a removable cross, as illustrated in FIG. 6*a*, or a adhesive sticker, as illustrated in FIG. 6*b* may be used as a removable cover.

Preferably, the package 10 and the hinged spout 20 are made of thermoplastic material. Such thermoplastic materials have been extensively described in the art and include vinyl chloride based resins, polymers and co-polymers derived from olefins, acrylic polymers and co-polymers, polyethylene, polypropylene, polystyrene, polyethylene terephthalate, polyethylene terephthalate glycol, or mixtures thereof. The container can be made of single or multi-layer extrusion of such materials. It can also comprise recycled thermoplastic materials. A preferred thermoplastic material used herein is polyethylene. Preferably the package 10 is made of low cost thermoplastic material such as polypropylene and formed by injection molding. Alternatively, the carton may be made of cardboard based material. The cardboard based material may be a multi-layer material comprising cardboard carton as the material giving rigidity to the package 10. In this case, the hinged spout 20 may be made of other materials like thermoplastic materials as described before or of a metal material. Aluminum is a possible metal material for the hinged spout 20.

While particular embodiments of the present invention have been illustrated and described, it would be obvious to those skilled in the art that various other changes and modifications can be made without departing from the spirit and scope of the invention. It is therefore, intended to cover in the appended claims all such changes and modifications that are within the scope of this invention.

We claim:

1. A package for dispensing tablets, comprising:

a dispensing opening having a hinged spout which receives a tablet from said dispensing opening in its open position, said hinged spout engaging with the rest of the package in its closed position;

a hook and holder for releasably engaging said hinged spout with the package, whereby said hook is flexibly and resiliently deflected from its rest position to releasably engage said holder; and wherein said hinged spout comprises a supporting wall, side walls and an end wall, said end wall being located on the same side of said supporting wall as said side walls and at least partially along the width of said supporting wall such that said side walls and said end wall retain a tablet on said supporting wall of said hinged spout.

2. The package of claim 1, further comprising a reinforcing means located adjacent said hook to counteract the disengagement direction of said hook from said holder.

3. The package of claim 2, wherein said reinforcing means is a rigid wall.

4. The package of claim 2, wherein said reinforcing means is a flexible and resilient spring.

5. The package of claim 2, wherein said reinforcing means is located below the hook when the package stands in an upright position.

6. The package of claim 1, wherein said end wall and said side walls are connected to each other.

7. The package of claim 1, wherein said hinged spout further comprises a stopping notch which limits the opening of said hinged spout to a partially opened position.

8. The package of claim 7, wherein said stopping notch is positioned on the outermost surface of said hinged spout.

9. The package of claim 7, wherein said dispensing opening comprises a retaining barrier.

10. The package of claim 9, wherein said retaining barrier is a flap extending from an edge of said dispensing opening.

11. The package of claim 9, wherein said retaining barrier is a removable cover.

12. The package of claim 9, further comprising a stopping notch which limits the opening of said hinged spout to a first partially opened position, wherein said first partial opened position allows only one tablet from a first row to exit onto said hinged spout and wherein said retaining barrier prevents a tablet from a second row from entering onto said hinged spout in said first partially opened position.

13. The package of claim 12, wherein said hinged spout has a second partially opened position and wherein said second partially open position allows a tablet from a second row to exit onto said hinged spout.

14. The package of claim 1, further comprising a funnel around said dispensing opening to dispense the tablets one-by-one from the interior of the package towards said dispensing opening.

15. The package of claim 1, further comprising dividers separating parallel rows of tablets from each other.

16. The package of claim 1, further comprising a refill opening.

17. The package of claim 1, further comprising a plurality of tablets.

18. The package of claim 1, wherein said hinged spout is adapted to receive one tablet at a time.

19. The package of claim 1, wherein said holder is a slot disposed on said end wall.

* * * * *